United States Patent [19]

Lucas

[11] Patent Number: 4,750,421

[45] Date of Patent: Jun. 14, 1988

[54] SCREEN PRINTING FRAME ASSEMBLY

[76] Inventor: Justin L. Lucas, Suite 1621, 500 Murray Ross Parkway, Downsview, Ontario, Canada, M3J 2Z3

[21] Appl. No.: 853,114

[22] Filed: Apr. 17, 1986

[51] Int. Cl.[4] ..... B05C 17/08; B41F 15/36

[52] U.S. Cl. ..... 101/128; 101/393

[58] Field of Search ..... 101/127.1, 128, 391, 101/392, 393, 368, 381, 398, 399; 160/371, 368 R, 369

[56] References Cited

U.S. PATENT DOCUMENTS

| | | | |
|---|---|---|---|
| 148,087 | 3/1874 | Reese | 101/128 |
| 2,267,044 | 12/1941 | Read | 101/393 X |
| 2,816,505 | 12/1957 | Michelson | 101/391 |
| 3,381,820 | 5/1968 | Cecka | 101/127.1 X |
| 3,541,957 | 11/1970 | Bubley | 101/127.1 |
| 4,282,805 | 8/1981 | Lala | 101/126 X |
| 4,287,826 | 9/1981 | Brabec | 101/126 X |

*Primary Examiner*—Edgar S. Burr
*Assistant Examiner*—Moshe I. Cohen
*Attorney, Agent, or Firm*—Robert F. Delbridge; Arne I. Fors

[57] ABSTRACT

A screen printing frame assembly has a rectangular main frame with laterally spaced side members, longitudinally spaced end members, and a pair of longitudinally spaced cross members extending between the side members. At least one rectangular sub-frame has laterally spaced side portions, longitudinally spaced end portions and a screen printing medium extending across the sub-frame, the screen printing medium bearing a single numeral to be printed. Each cross member has a sub-frame retaining portion engageable with a respective end portion of the sub-frame to retain the sub-frame in assembly therewith. One cross member has a main body portion relative to which the sub-frame retaining portion is slidably mounted, and the sub-frame retaining portion is resiliently urged relative to the main body portion to a sub-frame retaining position to enable the sub-frame to be assembled with the cross members by assembly with the resiliently mounted sub-frame retaining portion of the cross member and then with the sub-frame retaining portion of the other cross member.

6 Claims, 3 Drawing Sheets

SCREEN PRINTING FRAME ASSEMBLY

Figure 1:
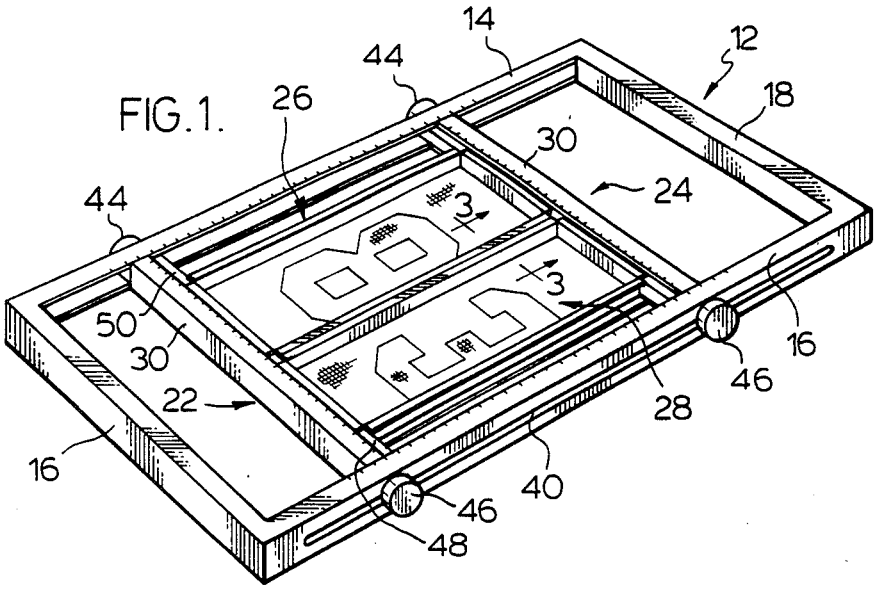

This invention relates to screen printing frame assemblies.

It is well known in various sports for a participant to have an identifying number on the front or back of a shirt or other garment worn by the participant. Such numbers are commonly printed on the garment by screen printing. An operator of screen printing equipment may have to print a variety of different numbers on different garments. However, with known screen printing frames, it is not as easy as desired to change from one number to another. Also, if the numbers are relatively long, for example, over about 10 inches (25 cms), problems may be encountered with the lack of rigidity of known screen printing frames.

It is therefore an object of the invention to provide an improved screen printing frame which is especially suitable for printing large or small, single or double digit numbers.

According to the invention, a screen printing frame assembly comprises a rectangular main frame having laterally spaced side members, longitudinally spaced end members, and a pair of longitudinally spaced cross members extending between the side members. The screen printing frame assembly also includes at least one rectangular sub-frame having laterally spaced side portions, longitudinally spaced end portions and a screen printing medium extending across the sub-frame, the screen printing medium bearing a single numeral to be printed.

Each cross member has a sub-frame retaining portion engagable with a rectangular end portion of the sub-frame to retain the sub-frame in assembly therewith. One cross member comprises a main body portion relative to which the sub-frame retaining portion is slided mounted. The sub-frame retaining portion is resiliently urged relative to the main body portion to a sub-frame retaining position to enable the sub-frame to be assembled with the cross members by assembly with the resilienty mounted sub-frame portion of the one cross member and then with the sub-frame retaining portion of the other cross member.

Thus, a sub-frame bearing a desired numeral can easily be replaced by another sub-frame bearing another numeral. Also, when the sub-frames are the same size, it is not necessary to move either of the cross members longitudinally, thereby avoiding interference with the setting thereof.

The end portions of the said frame may be of outwardly-facing channel shape for engagement over the sub-frame retaining portions of the cross members.

The main body portion of the one cross member may be of channel shape open towards the sub-frame, the sub-frame retaining portion being slidably mounted therein, with resilient means acting between the retaining portion and an opposing part of the main body of the cross member, and the cross member also having means to limit movement of the sub-frame retaining portion relative to the main body portion towards the sub-frame.

Means may be provided for adjusting the horizontal position of at least one of the cross members. Also, the side portions of the sub-frame are advantageously of outwardly-facing channel shape.

A pair of frames may be assembed in side by side relationship with the cross members. Where the numerals are relatively long, the sub-frames preferably have interengaging portions which resist frame distorting forces in a vertical plane A longitudinally extending reinforcing portion of channel shape may by secured within the channel shape side portion so as to project therefrom into engagement with the reinforcing portion of the other sub-frame to resist frame distorting forces in the vertical plane.

Figure 2:
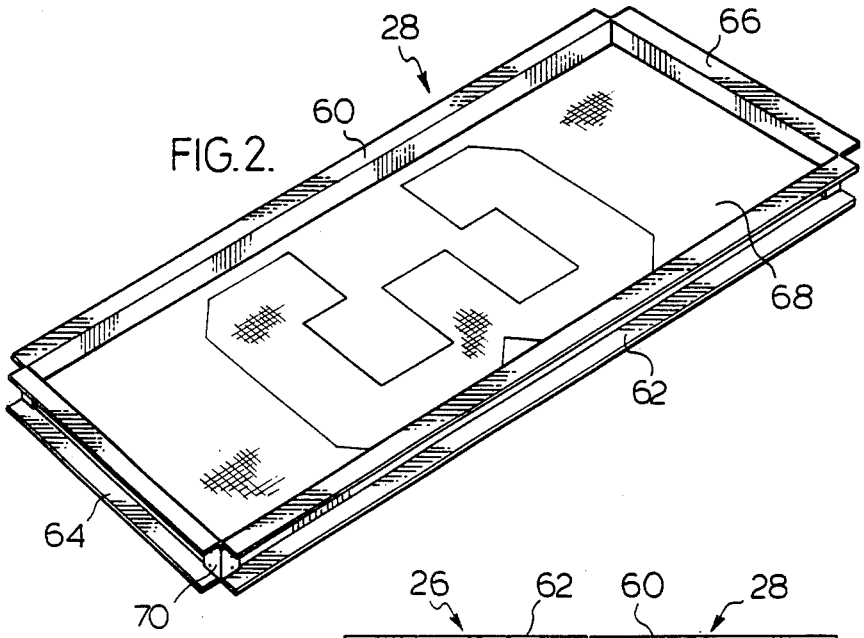
Figure 3:
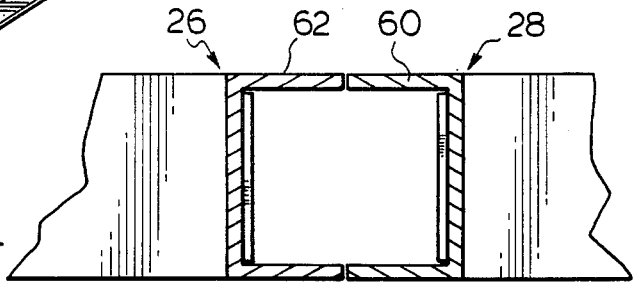
Figure 4:
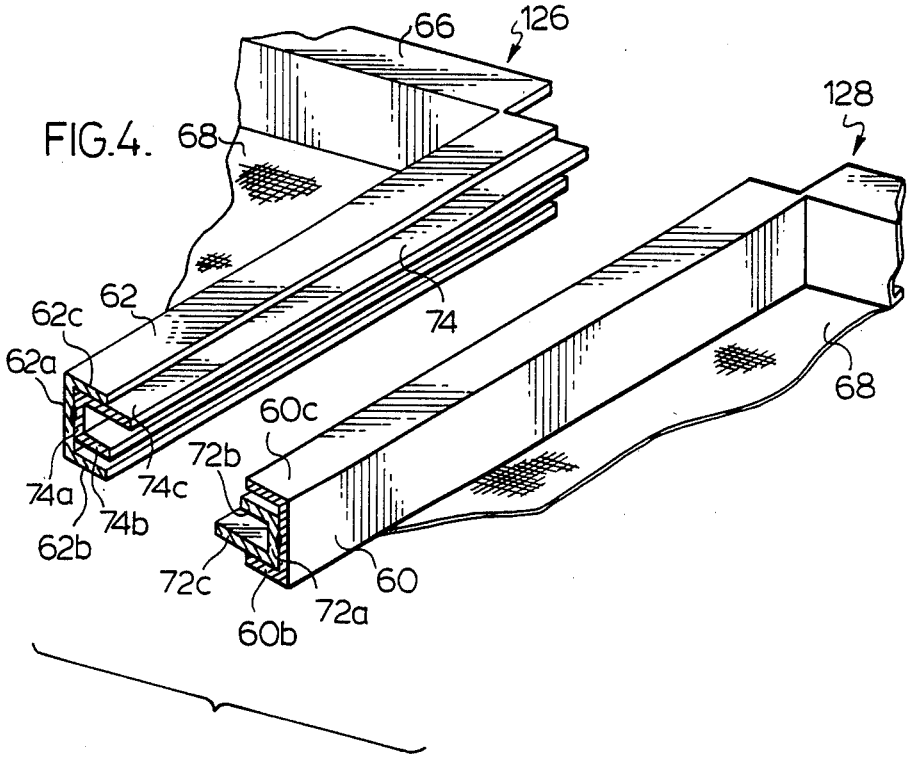
Figure 5:
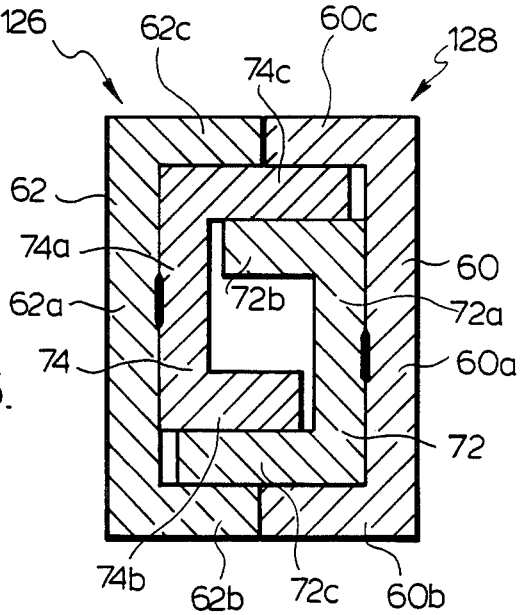
Figure 6:
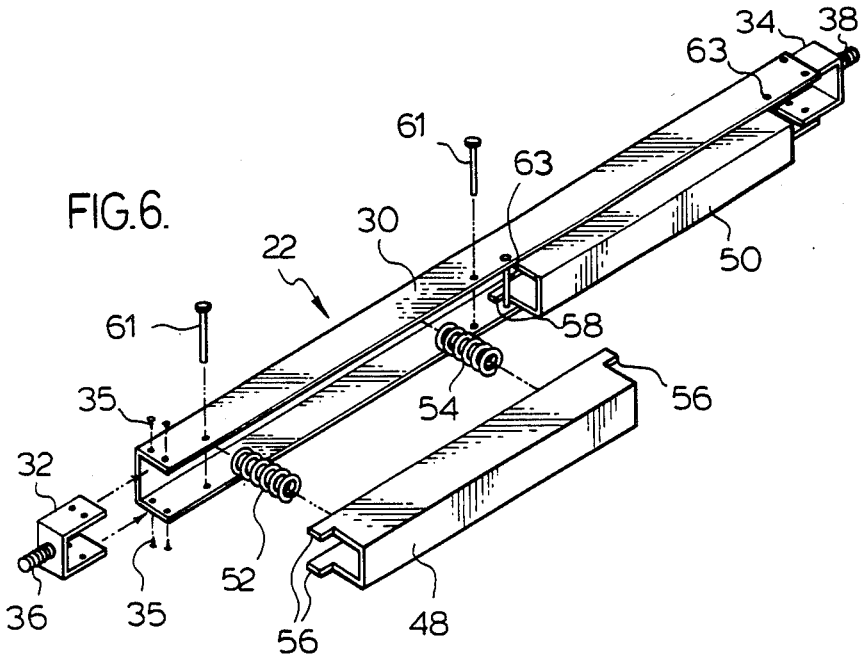
Figure 7:
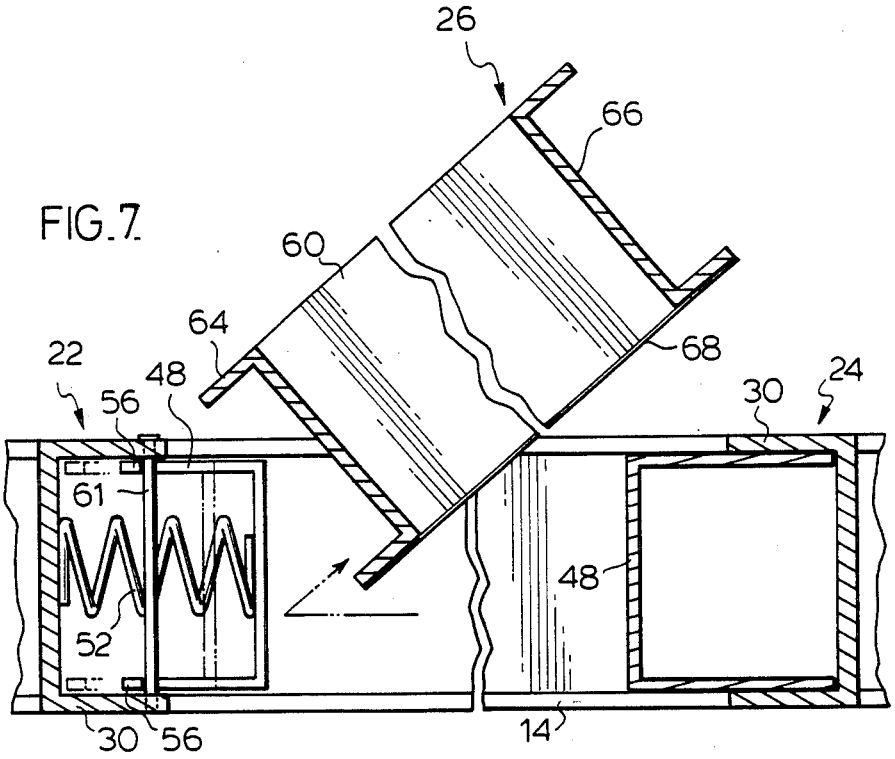

Embodiments of the invention will now be described, by way of example, with reference to the accompanying drawings, of which:

FIG. 1 is a perspective view of a screen printing frame assembly having two sub-frames, FIG. 2 is a similar view of one of the sub-frames, FIG. 3 is a sectional view along the line 3—3 of FIG. 1, FIG. 4 is an exploded fragmentary view of sub-frames with reinforced side portions, FIG. 5 is a sectional view similar to FIG. 3 but showing the reinforced side portions, FIG. 6 is an exploded view of the cross member with the resiliently mounted sub-frame retaining portion, and FIG. 7 is a longitudinal sectional view showing the manner in which a sub-frame is assembled with or removed from the cross members.

Referring to the drawings, a screen printing frame assembly includes a rectangular main frame 12 having laterally spaced side members 14, 16 and longitudinally spaced end members 18, 20, with side members 14, 16 and end members 18, 20 being of extruded aluminum. A pair of longitudinally spaced cross member 22, 24 extend between the side members 14, 16 and a pair of rectangular sub-frames 26 28 are mounted in side by side relationship between the cross members 22, 24.

Referring especially to FIGS. 6 and 7, a cross member 22 has a main body portion 30 of extruded aluminum with an inwardly facing channel section. Brackets 32, 34 are secured to opposite ends of the main body portion 30 by screws 35 and carry laterally projecting threaded studs 36, 38. The studs 36, 38 pass through longitudinally extending slots 40 in the main frame side members 14, 16, and lock nuts 44, 46 of plastic material are mounted on the projecting ends of the studs 36, 38 (See FIG. 1). Thus, the longitudinal position of cross member 22 can be adjusted by loosening the lock nuts 44, 46 and moving the cross member 22 to the desired position with the studs 36, 38 sliding in the slots 40. The lock nuts desired position. 44, 46 are then tightened to retain the cross member 22 in the The main body portion 30 of the cross member 22 contains two transversely spaced sub-frame retaining portions 48, 50 of extruded aluminmum and of rearwardly facing channel sections. The retaining portions 48, 50 are slidably mounted in the main body portion 30 for movement in a longitudinal direction relative to the main frame 12. Springs 52, 54 urge the retaining members 48, 50 away from the main body portion 30, with such movement being limited by stops 56, 58 on the retaining portions 48, 50 engaging pins 61, 63 mounted on the main body portion 30. The retaining portions 48, 50 project a substantial distance from the main body portion 30.

Referring more particularly to FIGS. 1 to 3, each sub-frame 26, 28 has laterally spaced side portions 60, 62, longitudinally spaced end portions 64, 66 and a screen printing medium 68 extended across the sub-frame, the screen printing medium 68 bearing a single numeral (digit) to be printed. Side portions 60, 62 and end portions 64, 66 are of steel and have outwardly-facing channel sections, the various portions being secured together by corner brackets 70.

The other cross member 24 also has a main body portion 30, with studs (not shown) passing through the slots 40 in the main frame side members 14, 16, and lock nuts 44, 46. However, the sub-frame retaining portion 48 is fixedly mounted in the main body portion 30 instead of being resiliently mounted as in the case of cross member 22, but as before projects substantially from the main body portion 30.

In use, the cross members 22, 24 are positioned as required by loosening and retightening the lock nuts 44, 46 as previously described. Referring to FIG. 7, a sub-frame 26 or 28 can be positioned for use by engaging an end portion 64 with the resiliently mounted retaining portion 48, of cross member 22, and moving the sub-frame 26 or 28 to cause rearward movements of the retaining portion 48 with compression of spring 52 until end portion 66 of the sub-frame can be fitted over retaining portion 48 of cross member 24. Spring 52 then extends to hold the sub-frame 26 or 28 securely in place. In this way, the two sub-frames 26, 28 are positioned side by side with their side portions 62, 60 abutting as shown in FIG. 3.

It will be noted that the screen printing frame assembly can easily be altered to print another number by removing one or both of the sub-frames 26, 28 and inserting one or two other sub-frames.

The sub-frame 26, 28 described above are satisfactory when the numbers to be printed are not too long, for example not greater than about 10 inches (25 cm). However, to provide frame rigidity when printing larger numbers, it is desirable to provide sub-frames 126, 128 with interengaging structure as shown in FIGS. 4 and 5. The sub-frames 126, 128 are generally similar to the sub-frames 26, 28 except that the side frame portions 60, 62 are each reinforced by an additional channel shaped steel member 72, 74 respectively.

The reinforcing member 72, 74 have vertically spaced portions **72*a*, 74*a*shorter horizontal arm portions 72*b*, 74*b* and longer horizontal arm portions 72*c*, 74*c*. The side portions 60, 62 have vertical base portions 60*a*, 62*a*, and arm portions 60*b*, 62*b* and 60*c*, 62*c* of equal length shorter than the shorter arm portions 72*b*, 74*b* of reinforcing members 72, 74. The base portions 72*a*, 74*a* of reinforcing members 72, 74 are shorter than base portions 60*a*, 62*a* of side frame portions 60, 62**.

The reinforcing member 74 is secured within the channel section of the side frame portion 62 with the longer horizontal arm portion **74*c* abutting and projecting beyond the arm portion 62*c*, the base portion 74*a* being spot-welded to the base portion 62*a*. The shorter arm portion 74*b* is spaced from the arm portion 62*b* by a distance slightly greater than the thickness of the longer arm portion 72*c*. Similarly, the reinforcing member 72 is secured within the channel section of the side frame portion 60 with the longer arm portion 72*c* abutting and projecting beyond the arm portion 60*b*, the base portion 72*a* being spot-welded to the base portion 60*a*. The shorter arm portion 72*b* is spaced from the arm portion 60*c* by a distance slightly greater than the thickness of the longer arm portion 74*c***.

Thus, when the two side frames 60, 62 are moved together with the arm portions **62*c*, 62*b* abutting the arm portions 60*c*, 60*b*, the arm portion 74*c* fits into the space between arm portions 72*b*, 60*c*, and the arm portion 72*c* fits into the space between arm portions 62*b*, 74*b*. The sub-frames 26, 28** are therefore interengaged with each other to resist distorting forces in the vertical plane.

The advantages of the invention will be clear from the above description of preferred embodiments. Other embodiments will be readily apparent to a person skilled in the art, the scope of the invention being defined in the appended claims.

What I claim as new and desire to protect by Letters Patent of the United States is:

1. A screen printing frame assembly comprising a rectangular main frame having laterally spaced side members, longitudinally spaced end members a pair of longitudinally spaced cross members extending between the side members, and at least one rectangular sub-frame having laterally spaced side portions, longitudinally spaced end portions and a screen printing medium extending across the sub-frame, said screen printing medium bearing a single numeral to be printed, said cross members each having a sub-frame retaining portion engageable with a respective end portion of the sub-frame to retain the sub-frame in assembly therewith, and one of said cross members comprising a main body portion relative to which its sub-frame retaining portion is slidably mounted, the end portions of the sub-frame are of outwardly-facing channel shape for engagement over the sub-frame retaining portions of the cross members and means resiliently urging its sub-frame retaining portion relative to the main body portion to a sub-frame retaining position to enable the sub-frame to be assembled with the cross members by assembly with the resiliently mounted sub-frame retaining portion of said one cross member and then with the sub-frame retaining portion of the other cross member.

2. A screen printing frame assembly according to claim 1 wherein the main body portion of said one cross member is of channel shape open towards the sub-frame, said sub-frame retaining portion being slidably mounted therein, said resilient means acting between the retaining portion and an opposing part of the main body of the cross member, and said cross member also having means to limit movement of the sub-frame retaining portion relative to the main body portion towards the sub-frame.

3. A screen printing frame assembly according to claim 1 also including means for adjusting the longitudinal position of at least one of the cross members.

4. A screen printing frame assembly according to claim 1 wherein the side portions of the sub-frame are of outwardly-facing channel shape.

5. A screen printing frame assembly according to claim 1 including a pair of said sub-frames having sides with portions which, when said sub-frames are assembled in side by side relationship between the cross members, interengage to resist sub-frame distorting forces in a vertical plane.

6. A screen printing frame assembly according to claim 1 including a pair of said sub-frames having side portions of outwardly-facing channel shape which abut one another when the sub-frames are assembled in side by side relationship with the cross members, said side portions each having a longitudinally extending reinforcing portion of outwardly-facing channel shape secured within the channel shaped side portion and projecting therefrom into engagement with the reinforcing portion of the side portion of the other sub-frame, when said sub-frames are assembled with the cross members, to resist sub-frame distorting forces in a vertical plane.

* * * * *